US011230359B2

(12) United States Patent
McGinley et al.

(10) Patent No.: US 11,230,359 B2
(45) Date of Patent: Jan. 25, 2022

(54) POWER STEERING SYSTEM FOR AN OUTDRIVE ENGINE AND METHOD FOR CONTROLLING SAME

(71) Applicant: BRP US Inc., Sturtevant, WI (US)

(72) Inventors: Samuel McGinley, Milwaukee, WI (US); Philip Bylsma, Brookfield, WI (US)

(73) Assignee: BRP US INC.

( * ) Notice: Subject to any disclaimer, the term of this patent is extended or adjusted under 35 U.S.C. 154(b) by 0 days.

(21) Appl. No.: 17/007,370

(22) Filed: Aug. 31, 2020

(65) Prior Publication Data

US 2021/0061431 A1 Mar. 4, 2021

Related U.S. Application Data

(60) Provisional application No. 62/893,930, filed on Aug. 30, 2019.

(51) Int. Cl.
*B63H 20/12* (2006.01)

(52) U.S. Cl.
CPC ..... *B63H 20/12* (2013.01)

(58) Field of Classification Search
CPC ..... B63H 20/12
See application file for complete search history.

(56) References Cited

U.S. PATENT DOCUMENTS

| | | | | |
|---|---|---|---|---|
| 6,881,106 | B1 * | 4/2005 | Gonring | B63H 21/21 440/1 |
| 8,011,981 | B2 * | 9/2011 | Mizutani | B63H 25/02 440/1 |
| 8,042,568 | B2 * | 10/2011 | Clausen | F15B 19/005 137/554 |
| 2010/0250069 | A1 * | 9/2010 | Murty | F04C 14/08 701/42 |

* cited by examiner

*Primary Examiner* — Stephen P Avila
(74) *Attorney, Agent, or Firm* — BCF LLP

(57) ABSTRACT

A power steering system for an outdrive engine has a steering actuator, a motor for operating the steering actuator, a motor speed sensor for determining at least indirectly a speed of the motor, a steering rate sensor for determining a steering rate, and a controller communicating with the steering rate sensor and with the motor speed sensor. The controller is programmed for determining if a fault has occurred in the power steering system based on the steering rate and the motor speed, and taking at least one steering fault action in response to the fault having occurred. A method for controlling a power steering system includes determining if a fault has occurred based on the steering rate and the speed of the motor, and taking at least one steering fault action in response to the fault having occurred.

20 Claims, 12 Drawing Sheets

POWER STEERING SYSTEM FOR AN OUTDRIVE ENGINE AND METHOD FOR CONTROLLING SAME

CROSS-REFERENCE TO RELATED APPLICATION

The present application claims priority to U.S. Provisional Patent Application Ser. No. 62/893,930, filed Aug. 30, 2019, entitled "Power Steering System For An Outdrive Engine and Method For Controlling Same", which is incorporated herein by reference in its entirety.

TECHNICAL FIELD

The present technology relates to power steering systems for outdrive engines and to methods for controlling a power steering system.

BACKGROUND

An outdrive engine for a boat comprises a propulsion unit that is steerable in the water to steer the boat. To assist the user of the boat in steering the propulsion unit, a power steering system is connected between a steering input device (for example a tiller, a helm assembly or a joystick) and the propulsion unit.

To monitor the performance of the power steering system, power steering systems typically monitor the steering input provided by the user of the outdrive engine and the response of the power steering system, which can be, for example, a change in the steering angle of the propulsion unit. If there is a mismatch between the steering input and the response of the power steering system that is above a certain threshold, a fault can be detected by the power steering system.

Such a mismatch between the steering input and the response of the power steering system may be caused, in a hydraulic power steering system, by pockets of air in the hydraulic circuit, which cause slip of the hydraulic pump. When large enough and/or in a sufficient amount, these pockets of air can negatively affect the operation of the power steering system when they reach the hydraulic pump, as the hydraulic pump spins through the pockets of air, and thus affect the performance of the power steering system.

A fully electric power steering system can also be subjected to such a mismatch between the steering input and the response of the power steering system. For example, damage to a gear or other transmission element, such as one or more missing gear teeth, may cause the electric power steering system to slip in a similar manner to the way the pocket(s) of air affects a hydraulic pump, and thus also affect the performance of the power steering system.

However, the monitoring of the change in steering input and the response of the power steering system has drawbacks since by the time a fault is detected, the user's ability to steer could already have been compromised. In addition, the monitoring of the change in steering input isn't always possible when the steering input is a tiller.

There is therefore a desire for a power steering system that could monitor its performance in a different way.

SUMMARY

It is an object of the present technology to ameliorate at least some of the inconveniences present in the prior art.

According to one aspect of the present technology, there is provided a power steering system for an outdrive engine including a propulsion unit steerable about a steering axis. The power steering system is operatively connected between a steering input device and the propulsion unit. The power steering system includes a steering actuator for pivoting the propulsion unit about the steering axis, a motor for operating the steering actuator in response to a steering input provided to the steering input device, a motor speed sensor for determining at least indirectly a speed of the motor, and a steering rate sensor for determining a steering rate of the propulsion unit about the steering axis. The power steering system further includes a controller communicating with the steering rate sensor for receiving a first signal indicative of the steering rate. The controller further communicates with the motor speed sensor for receiving a second signal indicative of the motor speed. The controller is configured to control the operation of the motor, and is programmed for determining if a fault has occurred in the power steering system based on the steering rate and the motor speed, and taking at least one steering fault action in response to the fault having occurred.

In some implementations, determining if the fault has occurred in the power steering system based on the steering rate and the speed of the motor includes determining if the fault has occurred for one of a predetermined amount of time and a predetermined amount of consecutive instances. Once the fault has occurred for the one of the predetermined amount of time and the predetermined amount of consecutive instances, the controller is programmed for taking the at least one steering fault action.

In some implementations, the at least one steering fault action includes at least a first steering fault action and a second steering fault action. The one of the predetermined amount of time and the predetermined amount of consecutive instances is one of a first predetermined amount of time and a first predetermined amount of consecutive instances. The first steering fault action is taken once the fault has occurred for the one of the first predetermined amount of time and the first predetermined amount of consecutive instances. Determining if the fault has occurred in the power steering system based on the steering rate and the speed of the motor further includes determining if the fault has occurred for one of a second predetermined amount of time and a second predetermined amount of consecutive instances. The second predetermined amount of time is greater than the first predetermined amount of time and the second predetermined amount of consecutive instances is greater than the first predetermined amount of consecutive instances. Once the fault has occurred for the one of the second predetermined amount of time and the second predetermined amount of consecutive instances, the controller is programmed for taking the second steering fault action.

In some implementations, determining if the fault has occurred in the power steering system based on the steering rate and the speed of the motor includes calculating a speed comparison indicator representative of a relationship between the steering rate and the speed of the motor, comparing the speed comparison indicator to a threshold speed comparison indicator for determining if the fault has occurred, and in response to the fault having occurred, the controller is programmed for taking the at least one steering fault action.

In some implementations, the at least one steering fault action is at least a first steering fault action and a second steering fault action, and the threshold speed comparison indicator is a first threshold speed comparison indicator. In response to the fault having occurred, the controller is programmed for taking the first steering fault action. Determining if the fault has occurred in the power steering system based on the steering rate and the speed of the motor further includes comparing the speed comparison indicator to a second threshold speed comparison indicator for determining if a second steering fault action is to be taken. Once the second steering fault action is determined to be taken, the controller is programmed for taking the second steering fault action.

In some implementations, the first steering fault action includes providing a warning indication to an operator of the power steering system.

In some implementations, the first steering fault action includes registering a fault code in the controller.

In some implementations, the second steering fault action includes limiting at least one of a maximum operative speed of the outdrive engine, a throttle request to the outdrive engine, and the speed of the motor of the power steering system.

In some implementations, the controller determines if the speed of the motor is above a threshold motor speed before determining if the fault has occurred in the power steering system based on the steering rate and the motor speed.

In some implementations, the steering actuator is a hydraulic steering actuator, and the motor is an electric motor driving a hydraulic pump.

In some implementations, the electric motor is a brushless direct current motor having an output shaft, and the motor speed sensor determines a rotational speed of the output shaft.

In some implementations, the controller is further configured to control the operation of the outdrive engine. The controller is configured to control at least one of the outdrive engine and the motor in response to the fault having occurred.

In some implementations, the steering input device is a tiller.

In some implementations, an outdrive engine includes an engine, a transmission operatively connected to the engine, a propelling device operatively connected to the transmission, and the power steering system as described above.

According to another aspect of the present technology, there is provided a method for controlling a power steering system of an outdrive engine. The method includes the steps of determining a steering rate of a propulsion unit of the outdrive engine about a steering axis, determining at least indirectly a speed of a motor of the power steering system, the motor being configured for operating a steering actuator of the power steering system, determining if a fault has occurred in the power steering system based on the steering rate and the speed of the motor, and taking at least one steering fault action in response to the fault having occurred.

In some implementations, the determining if a fault has occurred includes calculating one of a ratio of the speed of the motor over the steering rate and a ratio of the steering rate over the speed of the motor.

In some implementations, the determining if a fault has occurred includes calculating a normalized speed difference between the steering rate and the speed of the motor.

In some implementations, the method further includes the step of determining if the speed of the motor is above a threshold motor speed before determining if the fault has occurred.

In some implementations, the at least one steering fault action includes at least a first steering fault action and a second steering fault action, and the first steering fault action includes at least one of providing a warning indication to an operator of the power steering system, and registering a fault code in a controller.

In some implementations, the second steering fault action includes limiting at least one of a maximum operative speed of the outdrive engine, a throttle request to the outdrive engine, and the speed of the motor of the power steering system.

The above-described technology differs from the prior art systems in that the reduction in performance of the power steering system can be detected sooner than in power steering systems which rely on the monitoring of the change in steering input and the response of the power steering system. Since the detection of a problem in the power steering system occurs sooner using the above-described technology, the user can take preventive actions following, for example, a warning indication, to have the power steering system serviced. Moreover, since the detection of a problem in the power steering system occurs sooner using the above-described technology, a user is less likely to reach a situation where the performances of the power steering system are reduced to a point that materially affects its operation.

For the purposes of this application, terms related to spatial orientation such as forward, rearward, left, right, vertical, and horizontal are as they would normally be understood by a driver of a watercraft sitting thereon in a normal driving position with a marine outboard engine mounted to a transom of the watercraft.

For the purposes of this application, an outdrive engine includes a marine engine that includes a portion that is steerable in the water to steer the watercraft. Outdrive engines includes, but are not limited to, marine outboard engines, sterndrive engines, and pod drive engines.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Should there be any difference in the definitions of term in this application and the definition of these terms in any document included herein by reference, the terms as defined in the present application take precedence.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
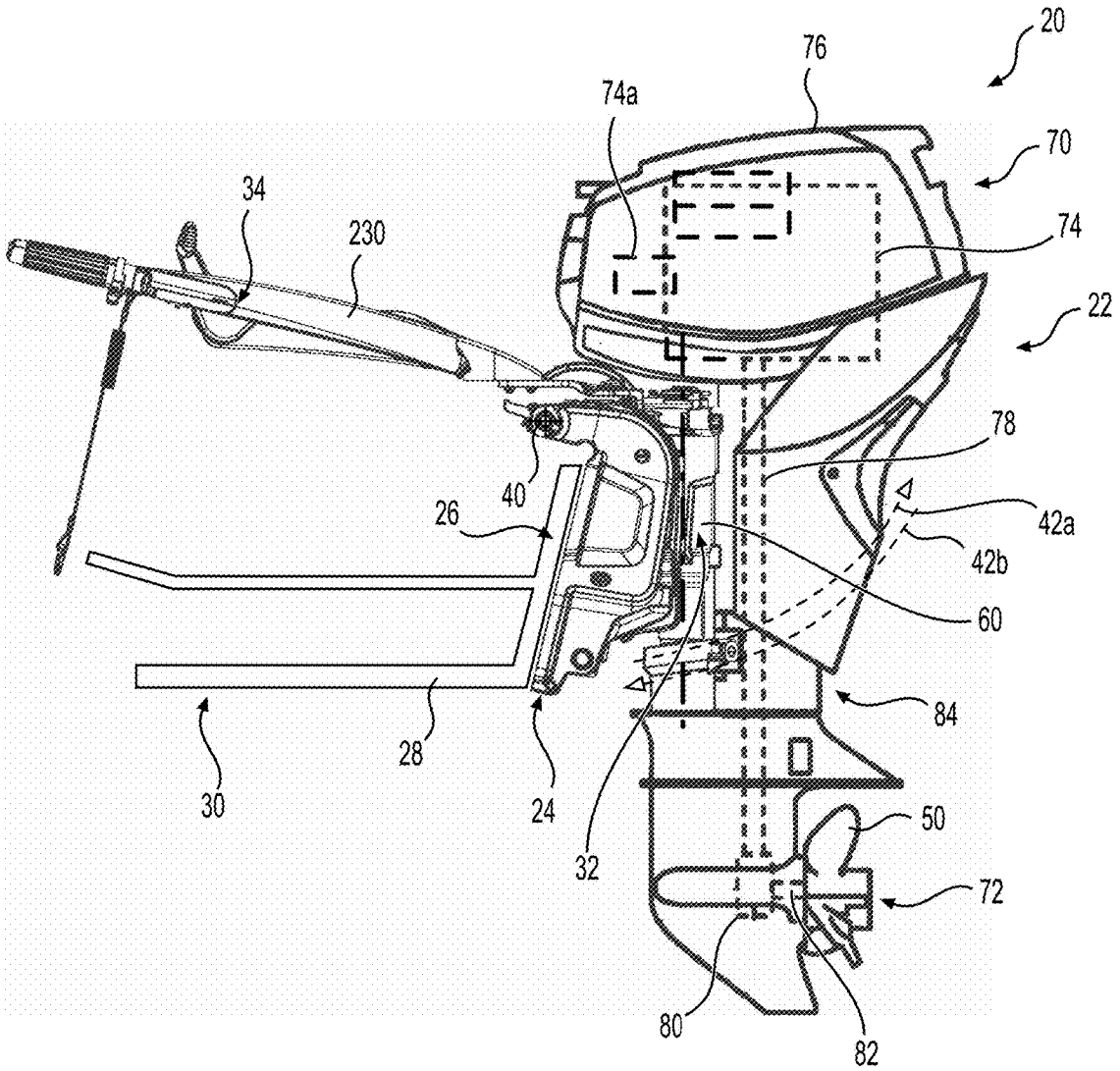
FIG. 1 is a left side elevation view of a marine outboard engine having a propulsion unit, a stern and swivel bracket assembly, a power steering system and a tiller system, mounted on a transom of a watercraft.

Referring to FIG. 1, the present technology will be described herein with reference to a marine outboard engine 20. However, it is contemplated that the present technology could be used in different types of outdrive engines, such as sterndrive engines, and pod drive engines.

With reference to FIGS. 1 to 4, the marine outboard engine 20, shown in the upright position, includes a propulsion unit 22, a stern and swivel bracket assembly 24 for mounting the propulsion unit 22 to a transom 26 of a hull 28 of a watercraft 30 (schematically shown in FIG. 1), and a power steering system 32 operated via a tiller system 34. The propulsion unit 22 is pivotably mounted to the stern and swivel bracket assembly 24 about a tilt/trim axis 40 extending generally horizontally. The propulsion unit 22 can be trimmed-up and tilted-up or down relative to the hull 28 of the watercraft 30 by a hydraulic linear tilt-trim actuator 42 of the stern and swivel bracket assembly 24. Arrows 42*a*, 42*b* in FIG. 1 show the pivoting motion of the propulsion unit 22. When the propulsion unit 22 is tilted down and within the trim range, a propeller 50 is in a submerged position when the watercraft 30 is supported on a surface of a body of water, and the propeller 50 propels the watercraft 30. The propulsion unit 22 can also be steered left or right (see FIG. 3) relative to the hull 28 of the watercraft 30 by a hydraulic steering actuator 60 of the stern and swivel bracket assembly 24 about a steering axis 62 (schematically shown in FIGS. 2 and 3). The steering axis 62 extends generally perpendicularly to the tilt/trim axis 40. When the propulsion unit 22 is in the upright position as shown in FIG. 1, the steering axis 62 extends generally vertically.

The propulsion unit 22 includes an upper portion 70 and a lower portion 72. The upper portion 70 includes an engine 74 (schematically shown in dotted lines in FIG. 1) surrounded and protected by a cowling 76, also called a cowl or engine cover. The engine 74 housed within the cowling 76 is an internal combustion engine, such as a two-stroke or four-stroke engine, having cylinders extending horizontally. It is contemplated that other types of engine could be used and that the cylinders could be oriented differently. It is also contemplated that the internal combustion engine 74 could be replaced by an electric motor. An engine management module 74*a* (hereinafter "EMM", schematically shown in FIG. 1) is operatively connected to the engine 74 and controls different functions of the outboard engine 20. The engine 74 is coupled to a driveshaft 78 (schematically shown in dotted lines in FIG. 1). When the propulsion unit 22 is in the upright position as shown in FIG. 1, the driveshaft 78 is oriented vertically. It is contemplated that the driveshaft 78 could be oriented differently relative to the engine 74. The driveshaft 78 is coupled to a transmission 80, which is located in the lower portion 72 of the propulsion unit 22, along with the propeller 50, which is operatively connected to the transmission 80 via a propeller shaft 82. A mid-portion 84 extends from the upper portion 70 to the transmission 80. The transmission 80 has a forward gear for propelling the marine outboard engine 20 forward, a neutral gear in which the transmission 80 decouples the propeller shaft 82 from the driveshaft 78, and a reverse gear for propelling the marine outboard engine 20 rearward.

In place of the propeller 50, it is contemplated that the propulsion unit 22 could alternatively include a jet propulsion device, turbine, impeller or other known propelling device. Other known components of a propulsion unit 22 are included within the cowling 76, such as a starter motor, an alternator and the exhaust system. As it is believed that these components would be readily recognized by one of ordinary skill in the art, further explanation and description of these components will not be provided herein.

Figure 4:
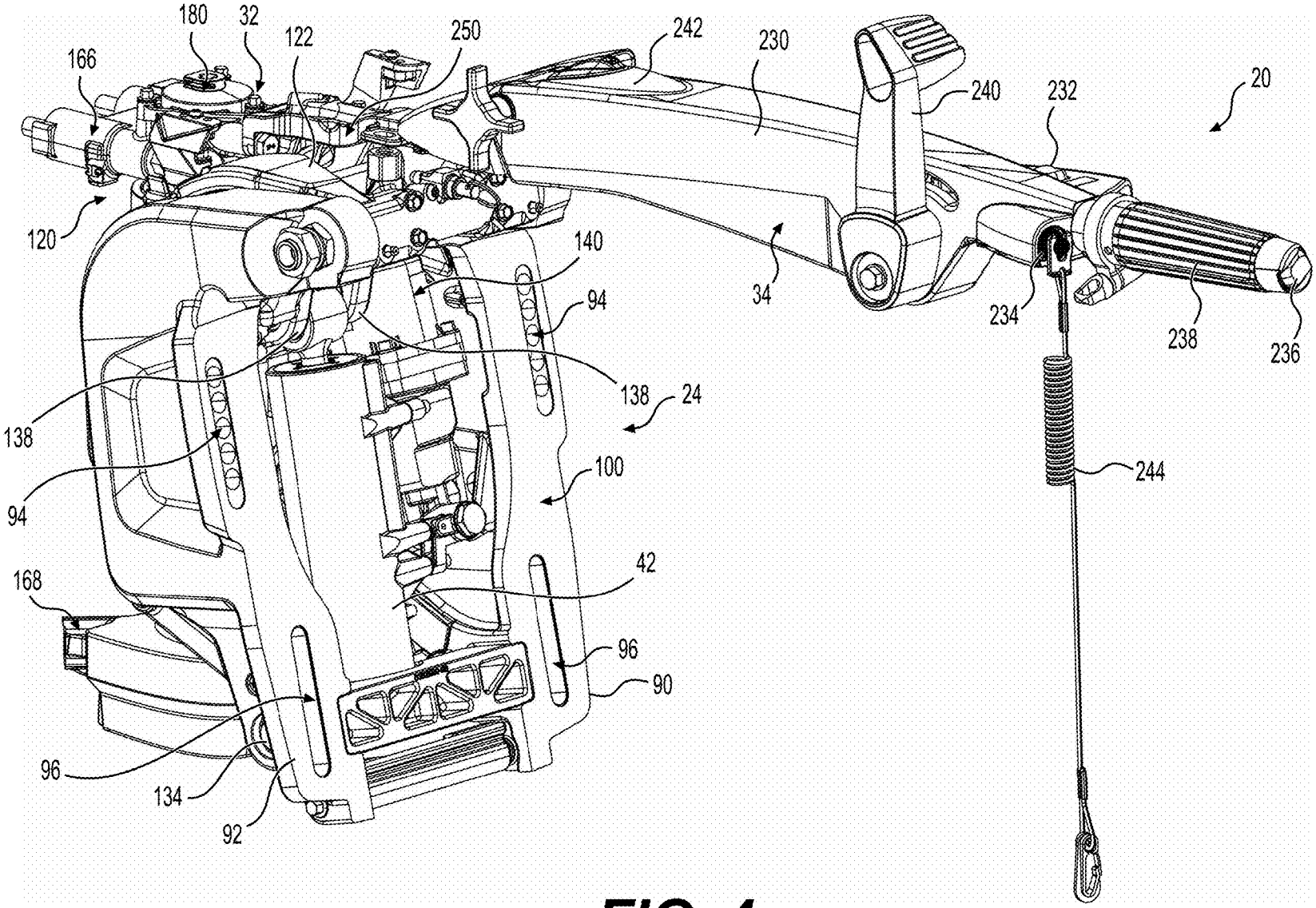
FIG. 4 is a perspective view taken from a front, right, top side of the components of FIG. 2.
Figure 5:
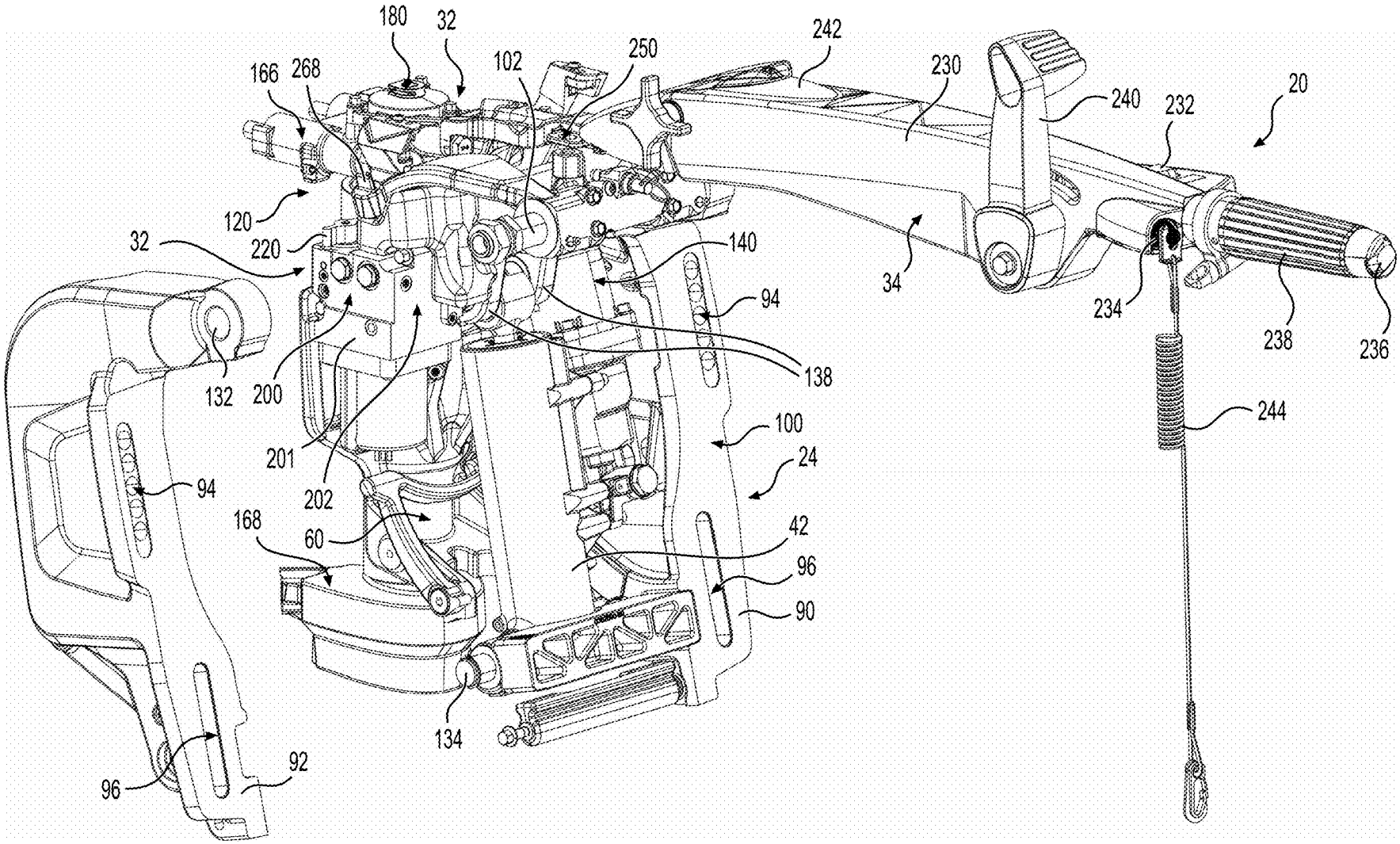
FIG. 5 is a partially exploded, perspective view taken from a front, right, top side of the components of FIG. 2.
Figure 6:
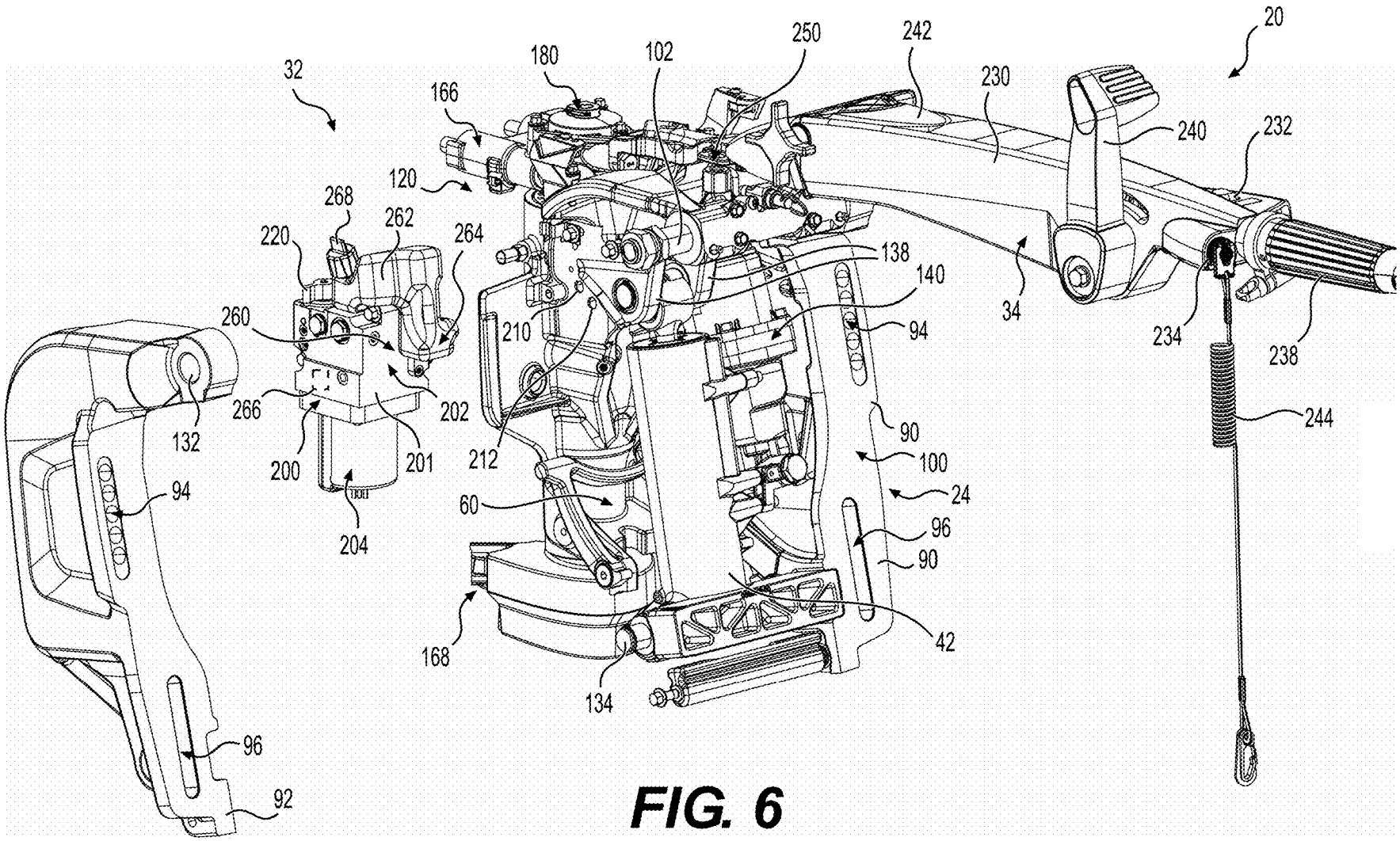
FIG. 6 is yet another partially exploded, perspective view taken from a front, right, top side of the components of FIG. 2.

Referring now to FIGS. 4 to 6, the stern and swivel bracket assembly 24 will be described in more details. The stern and swivel bracket assembly 24 includes two laterally spaced attachment members 90, 92 that contact the transom 26 or other suitable part of the watercraft 30 when the marine outboard engine 20 is mounted to the transom 26 or the other suitable part of the watercraft 30.

In the present implementation, two sets of upper mounting apertures 94 and two elongate lower apertures 96 are defined in the attachment members 90, 92 and are sized to receive bolts (not shown) therethrough and to allow for upward and downward adjustment of the securement position of the stern and swivel bracket assembly 24 relative to the transom 26 or the other suitable part of the watercraft 30. In the case of attachment to the transom 26 of the watercraft 30 shown in the accompanying Figures, bolts are inserted through the transom 26 and corresponding ones of the apertures 94, 96 and through corresponding apertures in the transom 26, and a nut is threaded onto each of the bolts and tightened to a suitable degree to secure the stern and swivel bracket assembly 24, and therefore also the propulsion unit 22, to the watercraft 30. It is contemplated that any other mounting mechanism could be used.

Figure 3:
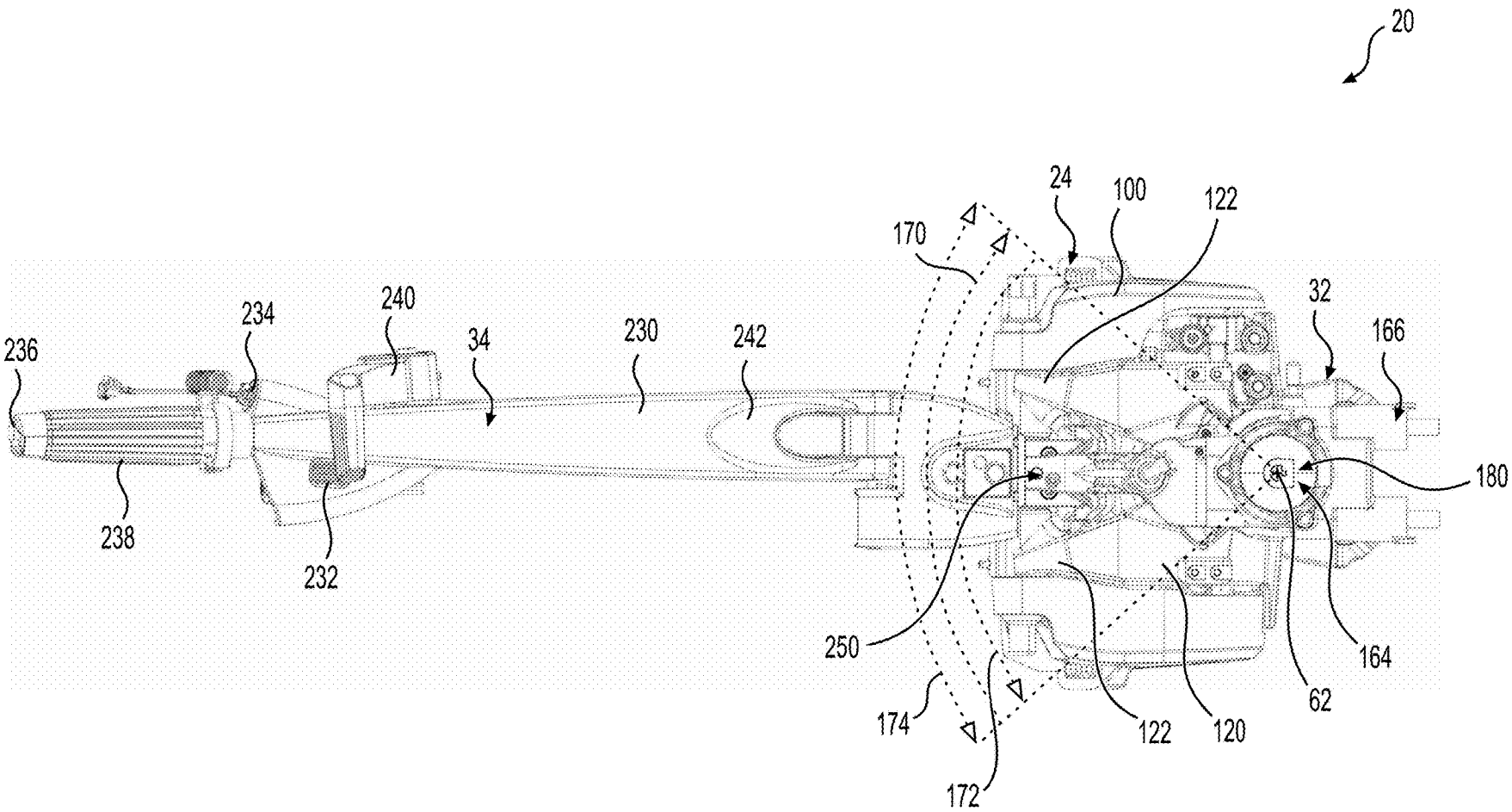
FIG. 3 is a top plan view of the components of FIG. 2.

The stern and swivel bracket assembly 24 further includes a stern bracket 100 pivotally connected to a swivel bracket 120 via a tilt axle 102 (FIGS. 5 and 6) extending through the stern bracket 100 and the swivel bracket 120. The tilt axle 102 is coaxial with the tilt/trim axis 40. As best shown in FIGS. 3 and 4, the swivel bracket 120 has two forwardly extending arms 122 having apertures defined therethrough, and the tilt axle 102 is received through these apertures.

The attachment members 90, 92 also define apertures 132 (FIGS. 5 and 6) for receiving the tilt axle 102 therethrough. In the present implementation, the tilt axle 102 is fixed with respect to the attachment members 90, 92 of the stern bracket 100, and the swivel bracket 120 rotates about the tilt axle 102. The attachment members 90, 92 further define apertures for receiving a lower pivot axle 134 of the hydraulic linear tilt-trim actuator 42. An upper pivot axle 136 of the hydraulic linear tilt-trim actuator 42 is received within tabs 138 defined in the swivel bracket 120. The hydraulic linear tilt-trim actuator 42 is thus operatively connected between the stern bracket 100 and the swivel bracket 120.

A hydraulic tilt/trim pump assembly 140 is mounted to the hydraulic linear tilt-trim actuator 42 and supplies hydraulic fluid to the hydraulic linear tilt-trim actuator 42. The tilt/trim pump assembly 140 is operable to adjust tilt/trim of the propulsion unit 22 about the tilt/trim axis 40. The hydraulic tilt-trim pump assembly 140 is located on a left side of the stern and swivel bracket assembly 24. More particularly, the hydraulic tilt-trim pump assembly 140 is located in a space extending laterally between the attachment member 90 of the stern bracket 100 and the hydraulic linear tilt-trim actuator 42. Moreover, the hydraulic tilt-trim pump assembly 140 is located below the tilt/trim axis 40. The hydraulic tilt-trim pump assembly 140 moves with the hydraulic linear tilt-trim actuator 42 when the the hydraulic linear tilt-trim actuator 42 extends to tilt or trim the swivel bracket 120 upward about the tilt/trim axis 40, or retracts to tilt or trim the swivel bracket 120 downward about the tilt/trim axis 40. It is contemplated that any other suitable combination of tilt/trim actuator and tilt/trim pump assembly 140 could be used in addition to or instead of the hydraulic linear tilt-trim actuator 42 and hydraulic tilt/trim pump assembly 140 described herein.

Figure 2:
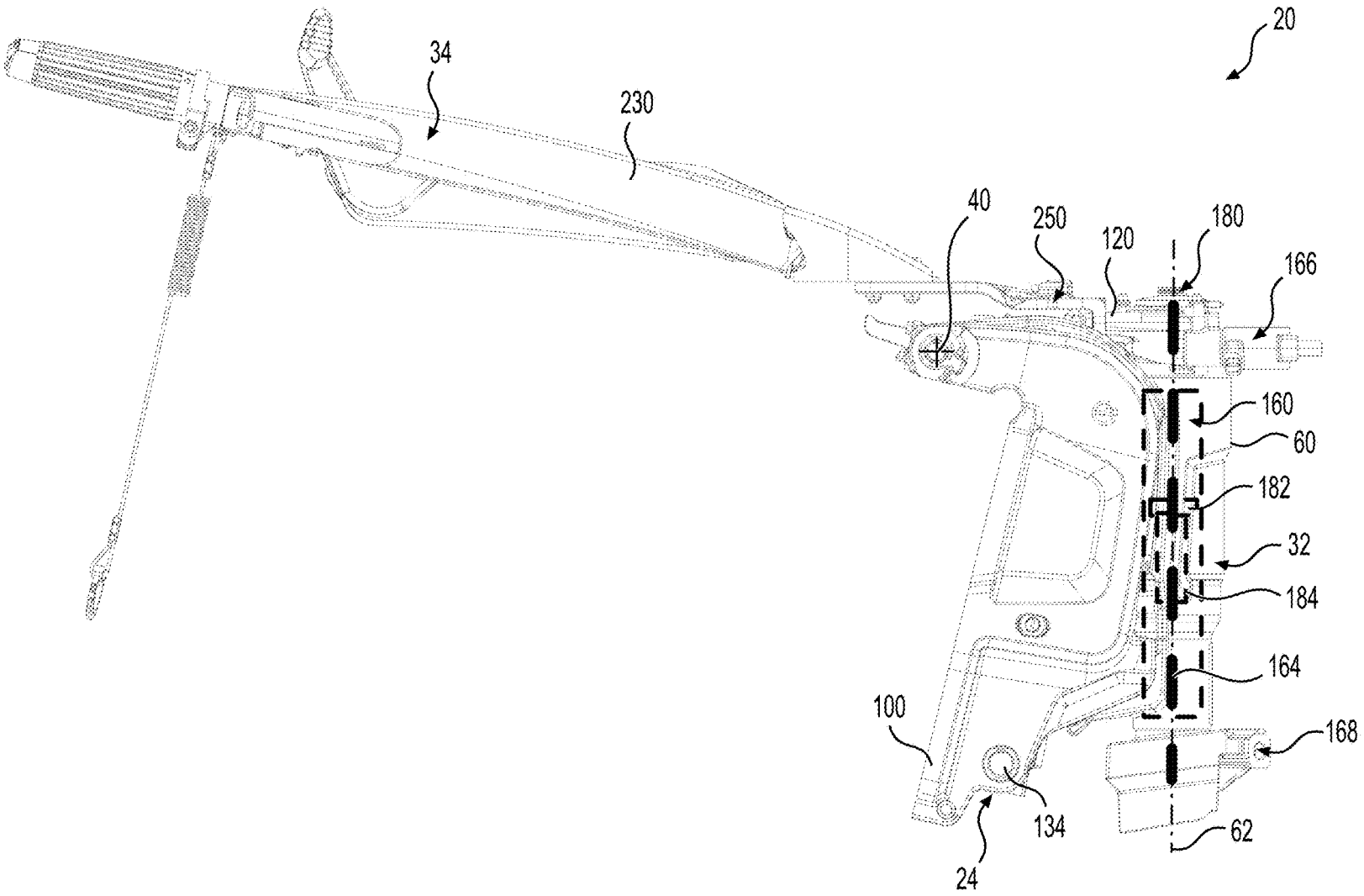
FIG. 2 is a left side elevation view of the stern and swivel bracket assembly, the power steering system and the tiller system of FIG. 1.
Figure 7:
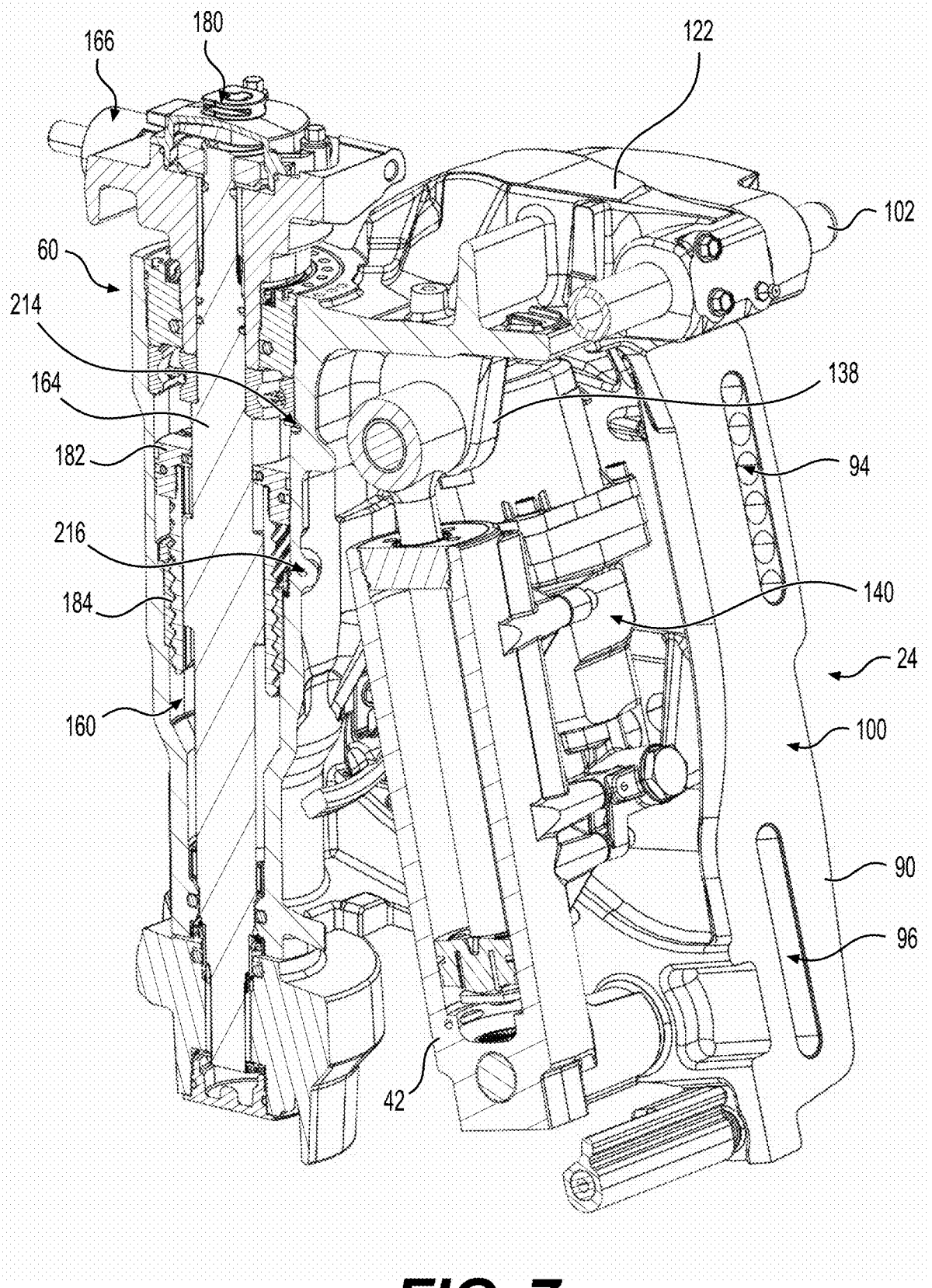
FIG. 7 is a perspective view taken from a front, top, right side of a longitudinal cross-section of the stern and swivel bracket assembly of the marine outboard engine of FIG. 1.

Referring to FIGS. 2 and 7, the swivel bracket 120 defines a cavity 160 in a rear end thereof and includes the hydraulic steering actuator 60. The hydraulic steering actuator 60 includes a pivot shaft 164, shown schematically in FIG. 2, that extends through the cavity 160 and is pivotably supported by the swivel bracket 120 about the steering axis 62. An upper end of the pivot shaft 164 extends upward out of the cavity 160 and the swivel bracket 120, and a lower end of the pivot shaft 164 extends downward out of the cavity 160 and the swivel bracket 120.

An upper motor mount 166 is connected to the upper end of the pivot shaft 164. As shown in FIG. 3, the upper motor mount 166 extends rearward from the pivot shaft 164 and includes two male mating portions that mate with corresponding female mating portions (not shown) defined in a forward-facing portion of the propulsion unit 22. A lower motor mount 168 is connected to the lower end of the pivot shaft 164 and extends downward from the bottom end of the pivot shaft 164. The lower motor mount 168 is similarly connected to the propulsion unit 22.

As can be seen in FIG. 3, the pivot shaft 164 is pivotable clockwise 170 and counter-clockwise 172, when the marine outboard engine 20 is viewed from above, about the steering axis 62 within a predefined pivot range 174. The propulsion unit 22 is connected to both the upper motor mount 166 and the lower motor mount 168 and pivots with the pivot shaft 164 within the pivot range 174. It is contemplated that any other mounting system and/or mounting connections could be used to connect the propulsion unit 22 to the pivot shaft 164. For example, it is contemplated that a single point, or more than two mounting points, could be used. It is also contemplated that the pivot range 174 could differ depending on each particular implementation and application of the marine outboard engine 20.

A steering position sensor 180 is connected to the upper end of the pivot shaft 164. The steering position sensor 180 is configured to sense a steering angle of the pivot shaft 164 relative to the swivel bracket 120, the steering angle being within the predefined pivot range 174, and output a signal indicative of that position, for example a voltage. Thus, the steering position sensor 180 can measure the steering angle of the propulsion unit 22 relative to the stern bracket 100. The steering position signal output by the sensor 180 can be used to calculate a steering rate of the pivot shaft 164, and thus a steering rate of the propulsion unit 22 about the steering axis 62. The steering rate can be determined by monitoring the change in steering angle of the pivot shaft 164 over time, for example over a sample rate. The steering rate could also be determined directly by an alternate steering position sensor 180 or calculated otherwise.

As shown schematically in FIG. 2 and best seen in FIG. 7, the hydraulic steering actuator 60 further includes a hydraulically-movable piston 182 and a screw drive 184. Both the piston 182 and the screw drive 184 are disposed inside the cavity 160. The piston 182 is mounted onto the pivot shaft 164 coaxially with the pivot shaft 164 and is movable upward and downward inside the cavity 160 along the pivot shaft 164. The screw drive 184 operatively couples the piston 182 to the pivot shaft 164 and also operatively couples the pivot shaft 164 to the swivel bracket 120 inside the cavity 160 such that upward and downward movement of the piston 182 along the pivot shaft 164 pivots the pivot shaft 164, and therefore also the propulsion unit 22, about the steering axis 62. U.S. Pat. No. 7,736,206 B1, issued Jun. 15, 2010, the entirety of which is incorporated herein by reference, provides additional details regarding rotary actuators similar in construction to the hydraulic steering actuator 60.

In the present implementation, movement of the piston 182 downward pivots the pivot shaft 164, and the propulsion unit 22, clockwise 170 about the steering axis 62, while movement of the piston 182 upward pivots the pivot shaft 164, and the propulsion unit 22, counter-clockwise 172 about the steering axis 62. It is contemplated that the screw drive 184 could be selected to reverse this steering action such that upward movement of the piston 182 would result in clockwise 170 steering, and downward movement of the piston 182 would result in counter-clockwise 172 steering. It is contemplated that a different coupling mechanism could be used to connect the piston 182 to the pivot shaft 164, instead of or in addition to the screw drive 184.

Now also referring to FIGS. 5 to 8, the piston 182 is movable upward and downward along the pivot shaft 164 by the hydraulic power steering system 32. In the present implementation, the hydraulic power steering system 32 includes a hydraulic power steering unit 200 that is mounted to the swivel bracket 120, but a different mounting location could be used. In this implementation, the hydraulic power steering unit 200 includes a body 201 enclosing a hydraulic power steering pump 202 that is driven by a bi-directional brushless direct current motor 204, further referred to as the power steering motor 204, that is also enclosed into the body 201 of the hydraulic power steering unit 200. It is contemplated that other types of motors could be used in other implementations.

As can be seen in FIGS. 6 and 7, the hydraulic power steering pump 202 is fluidly connected to the cavity 160 in the swivel bracket 120 at two locations. The swivel bracket 120 defines hydraulic steer ports 210, 212 facing laterally outward of a main body 121 of the swivel bracket 120 in a right lateral direction. In other words, the hydraulic steer ports 210, 212 face laterally outward toward the right side of the stern and swivel bracket assembly 24. A passage 214 defined within the main body 121 extends between the hydraulic steer port 210 and the cavity 160 above the piston 182. The hydraulic steer port 210 thus corresponds to a hydraulic steer-left port. Similarly, a passage 216 defined within the main body 121 extends between the hydraulic steer port 212 and cavity 160 below the piston 182. The hydraulic steer port 212 thus corresponds to a hydraulic steer-right port. The hydraulic steer ports 210, 212 and the passages 214, 216 permit the flow of hydraulic fluid therein.

The power steering unit 200 has a manual bypass valve 220. In the present implementation, the manual bypass valve 220 is integrated into the body 201 of the hydraulic power steering unit 200, but could be mounted elsewhere. The manual bypass valve 220 is manually operable between a normal operation position and a bypass position. The manual bypass valve 220 is in the normal operation position in the FIGS. 6 and 8. In the normal operation position, the manual bypass valve 220 allows fluid flow through each of the hydraulic steer ports 210, 212 and keeps the hydraulic steer ports 210, 212 fluidly isolated from each other.

When the manual bypass valve 220 is in the bypass position, the manual bypass valve 220 fluidly connects the hydraulic steer ports 210, 212 to each other inside the manual bypass valve 220 and thereby allows the piston 182 to move upward and downward along the pivot shaft 164 independent of the operation of the rest of the power steering system 32. This allows the propulsion unit 22 to pivot about the steering axis 62 independent of the operation of the power steering unit 200. It is contemplated that a different power steering system bypass could be used to decouple the piston 182 from the rest of the power steering system 32.

The hydraulic power steering system 32 is operatively connected to the tiller system 34. In other words, steering inputs provided by a user to the tiller system 34 are translated into operative commands of the power steering system 32. Generally described, the tiller system 34 is used for controlling operation of the propulsion unit 22, the transmission 80, the tilt/trim pump assembly 140 and the power steering system 32. The tiller system 34 includes a tiller arm 230, a start-stop switch 232, an engine cut-off switch 234, a tilt/trim control switch 236, a throttle control 238, a gear shift control 240, and the diagnostic light 242. The diagnostic light 242 is operable to shine in a plurality of different colors of light and different on-off light sequences that are visible to a user of the marine outboard engine 20 in order to provide various informational messages to the user. The engine cut-off switch 234 has a lanyard 244 attached thereto. The lanyard 244 is attachable to a user of the marine outboard engine 20 and shuts off the engine 74 when removed from the engine cut-off switch 234. It is contemplated that a different start-stop and/or safety shut-off system could be used.

The tiller arm 230, also referred to as a steering arm, connects a rear end of the tiller system 34 to the upper motor mount 166 and pivots with the propulsion unit 22 about the steering axis 62. It is contemplated that the tiller arm 230 could mount the tiller system 34 directly to the propulsion unit 22. As shown in FIGS. 1 and 2, the tiller arm 230 extends over the tilt/trim axis 40 when the propulsion unit 22 is fully trimmed down. An electronic torque sensor 250 is attached to the tiller arm 230 for providing an electronic steering signal used to control an operation of the power steering system 32. More particularly, in the present implementation, the electronic torque sensor 250 is a pair of strain gauges (not shown), which is attached, using a suitable adhesive, to the tiller arm 230. To this end, the strain gauges are oriented relative to the tiller arm 230 to sense torque applied to the tiller system 34 about the steering axis 62 in the clockwise 170 and counter-clockwise 172 directions by outputting the electric steering signal as a function of strain of the surface of the tiller arm 230 to which they are attached. The power steering system 32 is in communication with the electronic torque sensor 250 for receiving a signal indicative of the steering input provided by the user, and thus can operate the hydraulic power steering pump 202 accordingly.

Referring to FIGS. 5 to 8, the power steering system 32 will be described in more details. The power steering unit 200 is located on the right side of the swivel bracket 120. More particularly, the power steering unit 200 is located in the space extending laterally between the attachment member 92 of the stern bracket 100 and the hydraulic linear tilt-trim actuator 42. The power steering unit 200 is also located below the tilt/trim axis 40. Moreover, since the power steering unit 200 is mounted to the swivel bracket 120, the power steering unit 200 pivots together with the swivel bracket 120 about the tilt/trim axis 40.

The hydraulic pump 202 is operatively connected to the power steering motor 204. The pump 202 is a bi-directional electric pump. The direction of the flow of hydraulic fluid from the pump 202 can be changed by changing the direction of rotation of the motor 204. It is contemplated that the pump 202 could be a unidirectional pump, in which case it is contemplated that a system of valves could be used to vary the direction of the flow. It is also contemplated that other types of pumps could be used, such as, for example, axial flow pumps or reciprocating pumps. U.S. Pat. No. 9,499,247 B1, issued Nov. 22, 2016, the entirety of which is incorporated herein by reference, provides details regarding the construction and operation of a power steering system similar to the power steering system 32.

A manifold 260 is fluidly connected to the pump 202. A reservoir 262 is fluidly connected to the manifold 260 to contain the hydraulic fluid that is required to move the piston 182 of the hydraulic steering actuator 60. A hydraulic fluid level sensor 264 is fluidly connected to the hydraulic fluid reservoir 262. The hydraulic fluid level sensor 264 is operatively connected to a controller 266 (schematically shown in FIG. 6). A hydraulic fluid inlet 268 is also defined in the body 201 on a top face thereof. In other implementations, the controller 266 could be enclosed within the cowling 76 of the propulsion unit 22. In such an implementation, wires run from the motor 204 to the controller 266, from the steering position sensor 180 to the controller 266, and from the EMM **74*a* to the controller 266**.

Figure 8:
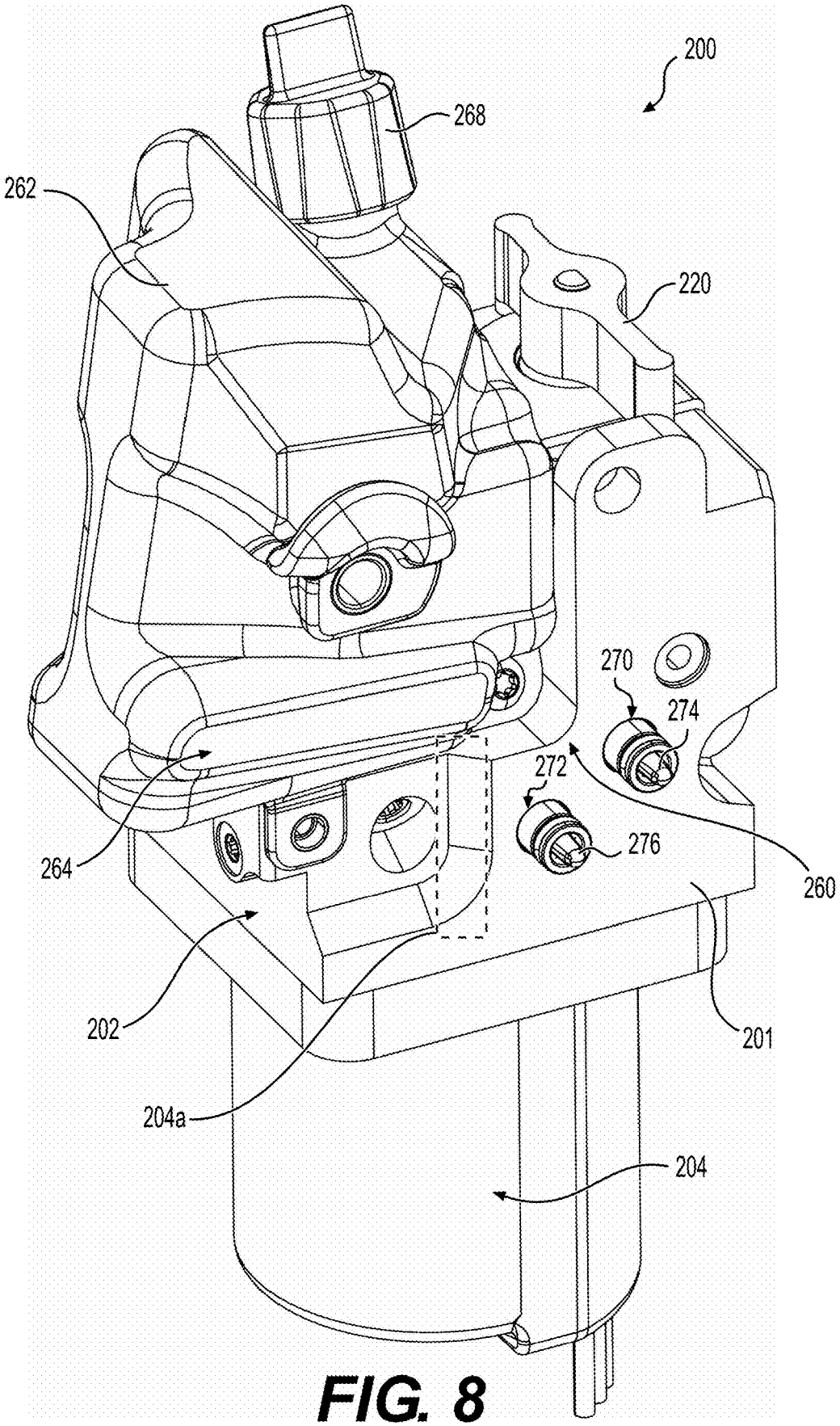
FIG. 8 is a perspective view taken from a front, top, left side of a power steering unit of the power steering system of the marine outboard engine of FIG. 1.

Referring to FIG. 8, the power steering unit 200 defines hydraulic steer ports 270, 272. The hydraulic steer ports 270, 272 are fluidly connected to the manifold 260. The hydraulic steer ports 270, 272 face laterally outward of the power steering unit 200 in a left lateral direction. In other words, the hydraulic steer ports 270, 272 face laterally outward toward the left side of the stern and swivel bracket assembly 24. Hydraulic nipples 274, 276 are received within the hydraulic steer ports 270, 272 respectively, and project laterally outwardly from the body 201.

Referring to FIGS. 5 to 8, when the power steering unit 200 is mounted to the swivel bracket 120, the hydraulic steer port 270 is fluidly connected to the hydraulic steer port 210 of the swivel bracket 120 through the hydraulic nipple 274. Similarly, the hydraulic steer port 272 is fluidly connected to the hydraulic steer port 212 of the swivel bracket 120 through the hydraulic nipple 276. As such, the hydraulic steer-left and steer-right ports 270, 272 of the power steering unit 200 are fluidly connected to the the hydraulic steer-left and steer-right ports 210, 212 of the swivel bracket 120.

In order to assist the user steering the propulsion unit 22 clockwise 170, hydraulic fluid is pumped by the pump 202 in the cavity 160 of the swivel bracket 120 via the hydraulic steer-left ports 210, 270 and, simultaneously, hydraulic fluid is pumped out of the cavity 160 via the hydraulic steer-right ports 212, 272, causing the piston 182 to move downwardly inside the cavity 160. Conversely, to aid in steering the propulsion unit 22 counter-clockwise 172, hydraulic fluid is pumped by the pump 202 in the cavity 160 via the hydraulic steer-right ports 212, 272 and, simultaneously, hydraulic fluid is pumped out of the cavity 160 via the hydraulic steer-left ports 210, 270, causing the piston 182 to move upwardly inside the cavity 160. Depending on the type of the pump 202 and the configuration of the power steering unit 200, the direction of flow of hydraulic fluid within the hydraulic steer-left and steer-right ports 270, 272 of the power steering unit 200 can be controlled by changing the direction of rotation of the motor 204, and/or by changing the configuration of a system of valves integrated into the manifold 260 as mentioned above. Such changing of the direction of flow of hydraulic fluid permits the power steering unit 200 to facilitate both clockwise 170 and counter-clockwise 172 steering motion of the propulsion unit 22.

Referring now to FIGS. 9 to 12, another aspect of the power steering system 32 will now be described, and this aspect concerns a method 300 of controlling the power steering system 32. The method 300 will be generally described referring to FIG. 9, and implementations of the method 300 will be described in FIGS. 10 to 12.

Figure 9:
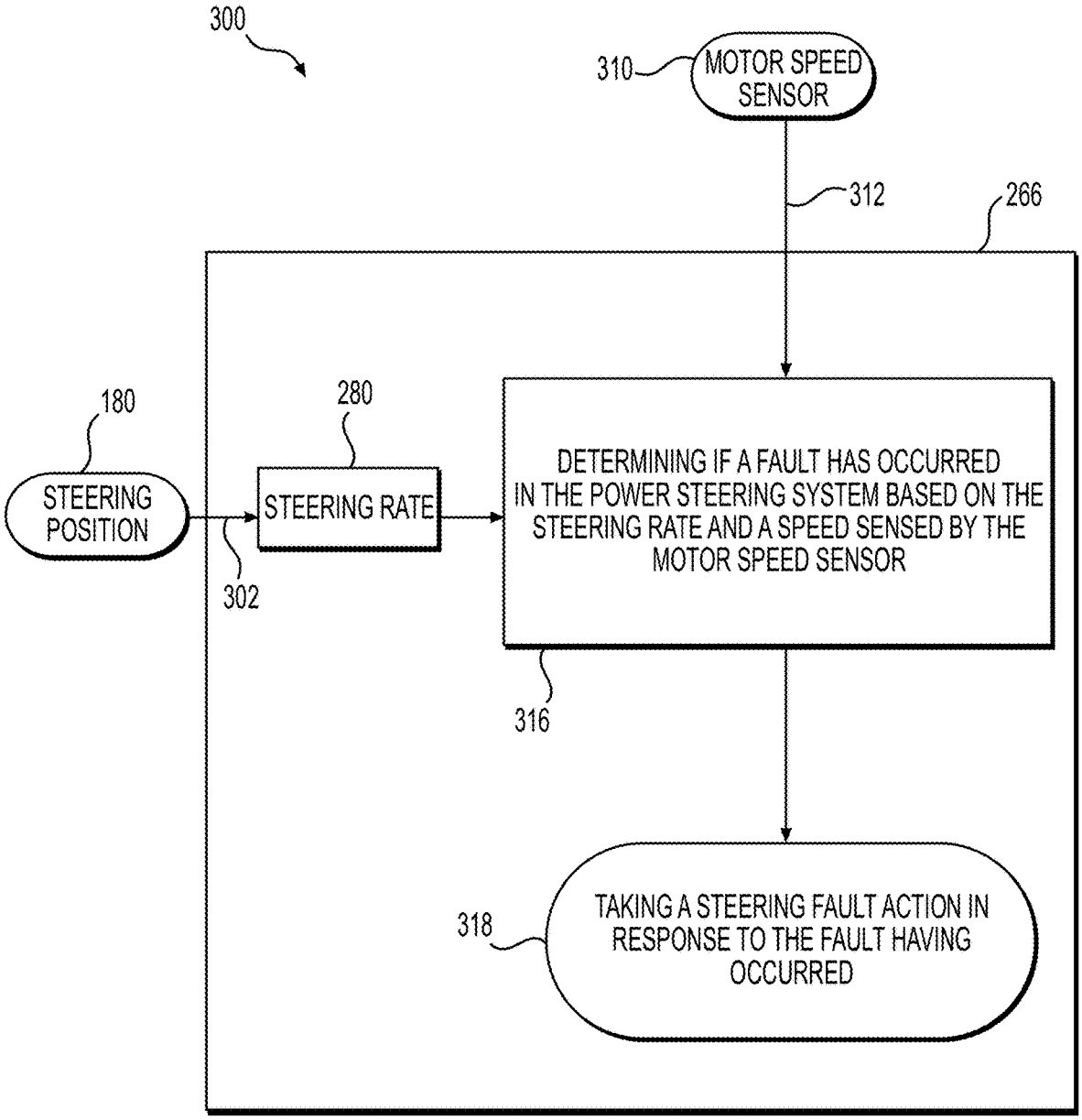
FIG. 9 is a flowchart of a method for controlling the power steering system of the marine outboard engine of FIG. 1.

Referring to FIG. 9, the controller 266 communicates with the steering position sensor 180 to receive a signal 302 indicative of the steering position of the pivot shaft 164. The controller 266 then determines the steering rate 280 of the pivot shaft 164 by dividing the change in steering position by the sensor sampling rate. The steering rate 280 is thus a measure of degrees of pivoting about the steering axis 62 over a unit of time (for example, degrees per second).

The controller 266 is also in communication with a motor speed sensor 310 that is configured for determining at least indirectly a speed of the motor 204. In the present implementation, the motor 204 has an output shaft 204*a* (schematically illustrated in FIG. 8), and the motor speed sensor 310 is configured to determine a rotational speed of the output shaft 204*a*. As such, the motor speed sensor 310 detects directly the speed of the motor 204. In another implementation, the motor speed sensor 310 could indirectly detect the speed of the output shaft 204*a* by sensing the speed of a transmission component, such as a gear, that varies directly with the output shaft 204*a*. In the present implementation, the motor 204 is capable of rotating the output shaft 204*a* between 0 rpm and up to about 8000 rpm in both directions. The motor speed sensor 310 is configured for emitting a signal 312 indicative of the motor speed. The controller 266 is configured to receive the signal 312. When the controller 266 receives the signals indicative of the steering input provided by the user from the electronic torque sensor 250, the motor 204 of the hydraulic power steering pump 202 is operated in accordance with the direction of the steering input (for steering the propulsion unit 22 clockwise 170 or counter-clockwise 172) and in accordance with the magnitude of the steering input provided by the user. For example, if the user provides a strong steering input, the speed of the motor 204 reaches up to about 8000 rpm and provides a greater boost force, thereby reducing the force exerted by the user. If the user provides a gentle steering input, the speed of the motor 204 is reduced (for example, about 4000 rpm), and thus provides less boost.

Based on the steering rate 280 and the motor speed sensed by the motor speed sensor 310, the controller 266 determines at step 316 if a fault has occurred in the power steering system 32. The controller 266 further takes an action at step 318, hereinafter referred to as a "steering fault action", in response to the fault having been detected. There exist different ways for the controller 266 to determine at step 316 if a fault has occurred in the power steering system 32. The following description describes alternative implementations for determining if a fault, i.e. a power steering malfunction, has occurred, and some of them could be performed in combination in certain implementations.

Figure 10:
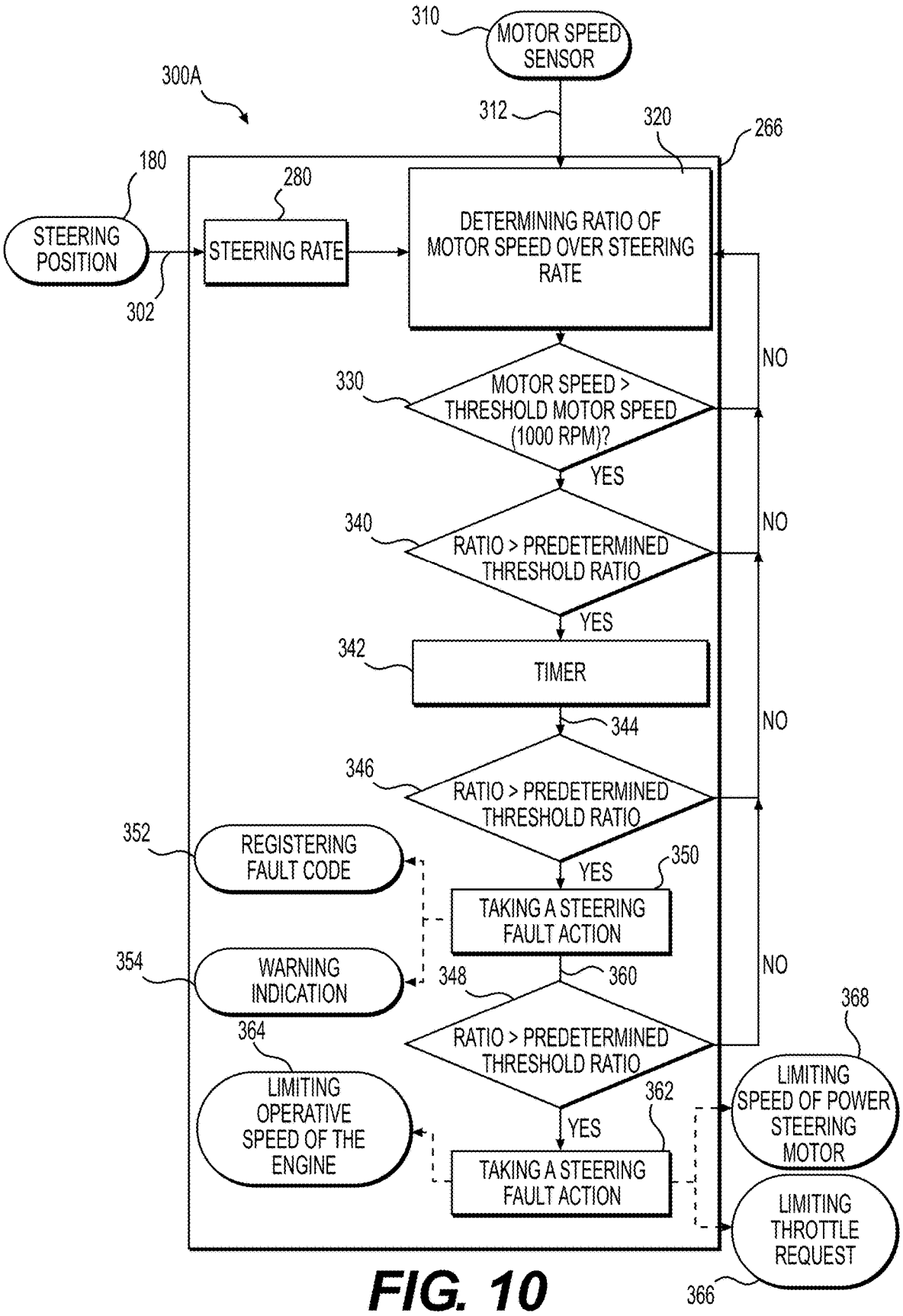
FIG. 10 is a flowchart of a first implementation of the method of FIG. 9.

In a first implementation 300A of the method and referring to FIG. 10, the controller 266 receives the signals 302, 312 at a predetermined rate. For example, the controller 266 receives the signals 302, 312 every 25 milliseconds. When receiving the signals 302, 312, the controller 266 determines a ratio at step 320 of the motor speed over the steering rate 280. In some implementations, the controller 266 determines an absolute value of the ratio at step 320 in order to obtain a positive figure.

Once the ratio is determined at step 320, the controller 266 checks at step 330 a condition that the motor speed (i.e. determined from signal 312) is above a threshold motor speed. The step 330 is performed in some implementations where the signal 312 may become noisy under certain conditions. For example, it has been found that when the motor 204 has a rotational speed between 0 and 1000 rpm (in either direction), the signal 312 generated by the motor speed sensor 310 is noisy and, at those speeds, the motor 204 is generally getting up to an appropriate speed for operating the pump 202, or slowing down to a stop.

If the condition is not satisfied at step 330 (i.e. the motor speed is below the threshold motor speed), the controller 266 disregards the ratio determined at step 320 and resets to receive the next signals 302, 312 from the following time interval, which is 25 milliseconds later in the present implementation.

If the condition is satisfied at step 330 (i.e. the motor speed is above the threshold motor speed), the controller 266 executes at step 340 a comparison of the ratio determined at step 320 with a predetermined threshold ratio. If the ratio determined at step 320 is below the predetermined threshold ratio, the speed of the motor 204 matches the expected steering rate 280 of the propulsion unit 22 and the controller 266 disregards the ratio determined at step 320 and resets to receive the next signals 302, 312 from the following time interval, which is 25 milliseconds later in the present implementation. Thus, having the ratio determined at step 320 below the predetermined threshold ratio indicates that the power steering system 32 is operating properly. If the ratio determined at step 320 is above the predetermined threshold ratio, the propulsion unit 22 is not being steered at a rate that matches the speed of the motor 204, indicating a problem with the power steering system 32, which in the present implementation is most likely the presence of air in the hydraulic system. In other implementations, a mismatch between the speed of the motor 204 and the steering rate 280 of the propulsion unit 22 could be indicative of a different type of malfunction, such as damage to one or more gears. Once a ratio determined at step 320 being above the predetermined threshold ratio has been detected, the controller 266 starts a timer 342 for determining a predetermined amount of time 344. In one example, the predetermined amount of time is of 0.5 seconds.

If the ratio determined at step 320 drops below the predetermined threshold ratio before the end of the predetermined amount of time 344, i.e. the condition of having the ratio determined at step 320 above the predetermined threshold ratio is no longer satisfied at the end of the predetermined amount of time 344, the controller 266 disregards the ratio determined at step 320 and resets to receive the next signals 302, 312 from the following time interval. If the ratio determined at step 320 remains above the predetermined threshold ratio for the predetermined amount of time 344, i.e. the controller 266 executes at step 346 a comparison of the ratio determined at step 320 with the predetermined threshold ratio and if the condition of having the ratio determined at step 320 above the predetermined threshold ratio is still satisfied at the end of the predetermined amount of time 344, a power steering fault has been detected. In the present implementation, the power steering fault is most likely a sufficient amount of air in the hydraulic system that corrective action is advisable. Accordingly, the controller 266 is programmed for taking a steering fault action at step 350.

In some implementations, taking the steering fault action at step 350 involves registering at step 352 the fault in a memory of the controller 266 by way of a fault code, or in the memory of another control unit, such as the EMM 74*a*, such that the fault code may be retrieved during maintenance operations of the marine outboard engine 20 for investigating the cause of that steering fault action 350. In some implementations, taking the steering fault action at step 350 involves providing at step 354 a warning indication to a user of the marine outboard engine 20. The providing at step 354 of the warning indication can be made by illuminating the diagnostic light 242 in a particular color and/or sequence. The providing at step 354 of the warning indication can also involve providing an audible indication to the user, and/or providing a haptic/force feedback in the tiller system 34 for notifying the user of the warning indication. In some implementations, taking the steering fault action at step 350 involves both registering the fault code (step 352) and providing a warning indication to the user (step 354).

When the timer 342 of the controller 266 reaches the predetermined amount of time 344, the timer 342 keeps on going and the controller 266 continues to execute the comparison at step 340 of the ratio 320 with the predetermined threshold ratio for determining if the condition has occurred over another predetermined amount of time 360. The predetermined amount of time 360 has the same starting time as the predetermined amount of time 344 and is greater than the predetermined amount of time 344. In one example, the predetermined amount of time 360 is of 2.5 seconds. The controller 266 executes at step 348 a comparison of the ratio determined at step 320 with the predetermined threshold ratio and if the ratio determined at step 320 remains above the predetermined threshold ratio over the predetermined amount of time 360, a more significant power steering fault has been detected. In the present implementation, the more significant power steering fault is most likely a sufficient amount of air in the hydraulic system that operation of the power steering system 32 may become compromised. Accordingly, and before the functioning of power steering system 32 is compromised, the controller 266 is programmed for taking an additional steering fault action at step 362.

The controller 266 is configured to communicate with the EMM 74*a*, which controls the operation of the engine 74, and taking the steering fault action at step 362 involves the controller 266 transmitting signals to the EMM 74*a* to control at least in part the operation of the engine 74 in response to the detection of a power steering fault. For example, in some implementations, when taking the steering fault action at step 362, the controller 266 instructs the EMM 74*a* to limit at step 364 a maximum operative speed of the engine 74. For example, the controller 266 could limit the operative speed of the engine 74 to propel the watercraft 30 on the water at no more than a predetermined maximum speed. In another example, when taking the steering fault action at step 362, the controller 266 limits at step 366 a throttle request to the engine 74 so as to propel the watercraft 30 on the water at no more than a predetermined maximum speed.

In other implementations, taking the steering fault action at step 362 involves limiting at step 368 the speed of the motor 204 of the power steering system 32 so as to reduce the performance of the power steering system 32. It is contemplated that the above examples of steering fault action at step 362 could be combined, and that the controller 266 could control different components and systems of the marine outboard engine 20.

In response to and/or in complement of the steering fault actions (steps 350, 362) described above, a user of the power steering system 32 could move the manual bypass valve 220 in the bypass position, and thus operate the marine outboard engine 20 without the assistance of the power steering system 32.

Figure 11:
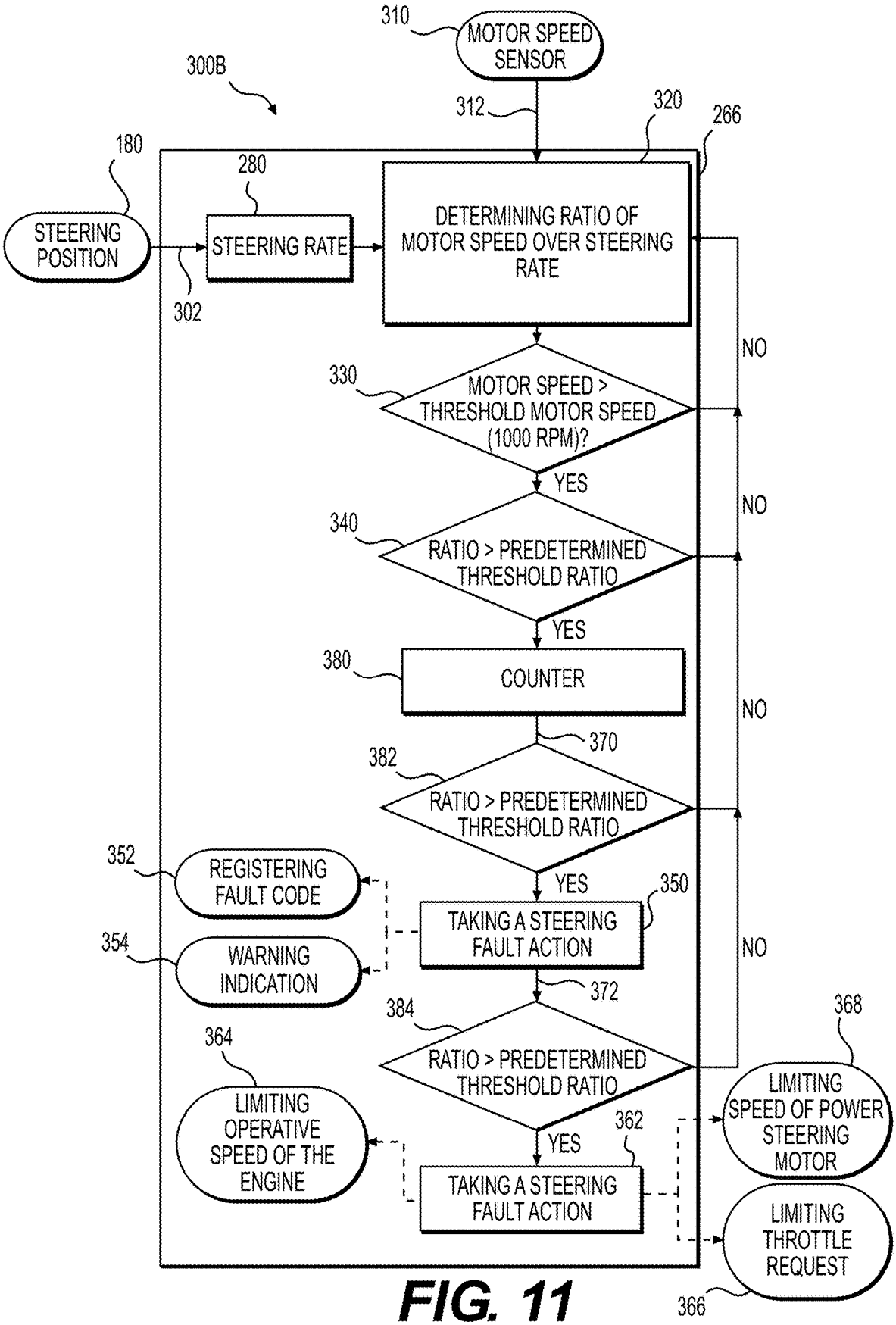
FIG. 11 is a flowchart of a second implementation of the method of FIG. 9.

Referring to FIG. 11, the method 300B will be described. The method 300B includes a second implementation of the step for determining if a fault has occurred. In the method 300B, the controller 266 no longer assesses whether the ratio determined at step 320 is above the predetermined threshold ratio over predetermined amounts of time 344, 360, but rather assess whether the ratio determined at step 320 is above the predetermined threshold ratio for predetermined numbers of consecutive instances 370, 372.

More particularly, if the controller 266 determines at step 340 that the ratio determined at step 320 is above the predetermined threshold ratio, the controller 266 increments a counter 380 for determining the amount of consecutive instances 370. If the ratio determined at step 320 does not drop below the predetermined threshold ratio for the predetermined amount of consecutive instances 370, the controller 266 disregards the ratio determined at step 320 and resets to receive the next signals 302, 312 from the following instance. Thus, having the ratio determined at step 320 below the predetermined threshold ratio indicates that the power steering system 32 is operating properly. The controller 266 executes at step 382 a comparison of the ratio determined at step 320 with the predetermined threshold ratio and if the ratio determined at step 320 remains above the predetermined threshold ratio for the predetermined amount of consecutive instances 370, the controller 266 is programmed for taking the steering fault action at step 350. For example, in implementations where the signals 302, 312 are received by the controller 266 every 25 milliseconds, the predetermined amount of consecutive instances 370 is twenty (20), and thus if the fault occurs for twenty consecutive instances 370, a power steering fault has been detected and the controller 266 is programmed for taking the steering fault action at step 350.

When the counter 380 of the controller 266 reaches the predetermined amount of consecutive instances 370, the controller 266 executes at step 384 a comparison of the ratio determined at step 320 with the predetermined threshold ratio for determining if the condition has occurred for the predetermined amount of consecutive instances 372. The predetermined amount of consecutive instances 372 is greater than the predetermined amount of consecutive instances 370. If the condition does not occur for the predetermined amount of consecutive instances 372, the controller 266 disregards the ratio determined at step 320 and resets to receive the next signals 302, 312 from the following instance. If the ratio determined at step 320 remains above the predetermined threshold ratio for the predetermined amount of consecutive instances 372, the controller 266 is programmed for taking the steering fault action at step 362. For example, in implementations where the signals 302, 312 are received by the controller 266 every 25 milliseconds, the predetermined amount of consecutive instances 372 is one hundred (100), and thus if the fault occurs for one hundred consecutive instances 372, the controller 266 is programmed for taking the steering fault action at step 362.

Figure 12:
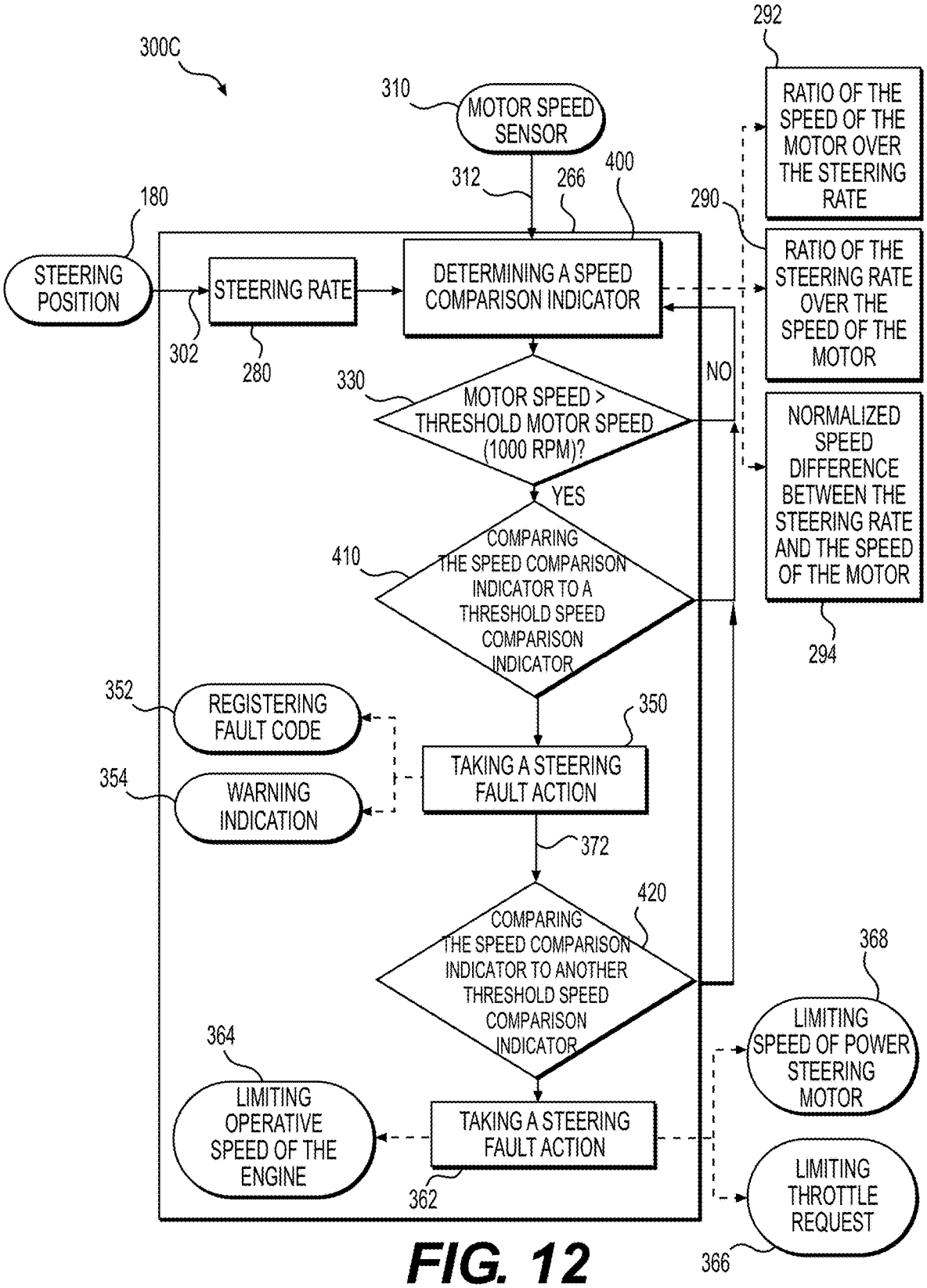
FIG. 12 is a flowchart of a third implementation of the method of FIG. 9.

Referring to FIG. 12, the method 300C will be described. The method 300C includes a third implementation of the step for determining if a fault has occurred. In the method 300C, the controller 266 first determines at step 400 a "speed comparison indicator", which is a variable representative of a relationship between the steering rate 280 and the motor speed at one given moment. As the name suggests, the speed comparison indicator is a figure that is destined to be used for comparison purposes by the controller 266. As indicated in FIG. 12, the speed comparison indicator could be any one of a ratio 290 of the steering rate 280 over the motor speed, a ratio 292 of the motor speed over the steering rate 280, a normalized speed difference 294 between the steering rate 280 and the motor speed, or any other figure representative of a relationship between the steering rate 280 and the motor speed.

As in the methods 300A, 300B, the controller 266 checks at step 330 the condition that the motor speed (i.e. determined from signal 312) is above a threshold motor speed. If the motor speed is above the threshold motor speed, the controller 266 then compares at step 410 the instant speed comparison indicator to a threshold speed comparison indicator for determining if a fault has occurred. Depending on the nature of the speed comparison indicator, the comparing operation performed by the controller 266 at step 410 can vary.

For example, if the speed comparison indicator is the ratio of the motor speed over the steering rate 280, the controller 266 determines that a fault has occurred when the speed comparison indicator is above the threshold speed comparison indicator. Conversely, if the speed comparison indicator is the ratio of the steering rate 280 over the motor speed, the controller 266 determines that a fault has occurred when the speed comparison indicator is below the threshold speed comparison indicator. In response to the fault having occurred, the controller 266 is programmed to take the steering fault action at step 350. Taking the steering fault action at step 350 includes registering at step 352 the fault code and/or providing at step 354 a warning indication to the user, as described above.

In some implementations, the controller 266 further compares at step 420 the instant the speed comparison indicator to another threshold speed comparison indicator being greater (or lower depending on the nature of the speed comparison indicator) than the threshold speed comparison indicator used at step 410. If the instant speed comparison indicator is above (or below depending on the nature of the speed comparison indicator) the threshold speed comparison indicator, the controller 266 is programmed for taking the steering fault action at step 362.

It is to be understood that aspects of the present technology can be used not only in hydraulic power steering systems, such as the power steering system 32 described herein, but also in fully electric power steering systems (for example, fly-by-wire systems) as the steering rate 280 and the speed of the motor ultimately effecting the power steering assistance are compared to assess the performance of the power steering system.

It will be appreciated that the various implementations of the method may be carried out by, for example, using the technology described herein above, or as another example using a suitable combination of conventionally known technology configured using conventionally known engineering principles to carry out the steps of the method.

Modifications and improvements to the above-described implementations of the present technology may become apparent to those skilled in the art. The foregoing description is intended to be exemplary rather than limiting.

The invention claimed is:

1. A power steering system for an outdrive engine including a propulsion unit steerable about a steering axis, the power steering system being operatively connected between a steering input device and the propulsion unit, the power steering system comprising:

a steering actuator for pivoting the propulsion unit about the steering axis;

a motor for operating the steering actuator in response to a steering input provided to the steering input device;

a motor speed sensor for determining at least indirectly a speed of the motor;

a steering rate sensor for determining a steering rate of the propulsion unit about the steering axis; and a controller communicating with the steering rate sensor for receiving a first signal indicative of the steering rate, the controller further communicating with the motor speed sensor for receiving a second signal indicative of the motor speed, the controller being configured to control the operation of the motor, and being programmed for:

a) determining if a fault has occurred in the power steering system based on the steering rate and the motor speed; and b) taking at least one steering fault action in response to the fault having occurred.

2. The power steering system of claim 1, wherein determining if the fault has occurred in the power steering system based on the steering rate and the speed of the motor includes determining if the fault has occurred for one of a predetermined amount of time and a predetermined amount of consecutive instances, and once the fault has occurred for the one of the predetermined amount of time and the predetermined amount of consecutive instances, the controller is programmed for taking the at least one steering fault action.

3. The power steering system of claim 2, wherein:

the at least one steering fault action comprises at least a first steering fault action and a second steering fault action;

the one of the predetermined amount of time and the predetermined amount of consecutive instances is one of a first predetermined amount of time and a first predetermined amount of consecutive instances, and the first steering fault action is taken once the fault has occurred for the one of the first predetermined amount of time and the first predetermined amount of consecutive instances; and determining if the fault has occurred in the power steering system based on the steering rate and the speed of the motor further includes determining if the fault has occurred for one of a second predetermined amount of time and a second predetermined amount of consecutive instances, the second predetermined amount of time being greater than the first predetermined amount of time and the second predetermined amount of consecutive instances being greater than the first predetermined amount of consecutive instances, and once the fault has occurred for the one of the second predetermined amount of time and the second predetermined amount of consecutive instances, the controller is programmed for taking the second steering fault action.

4. The power steering system of claim 1, wherein determining if the fault has occurred in the power steering system based on the steering rate and the speed of the motor includes:

calculating a speed comparison indicator representative of a relationship between the steering rate and the speed of the motor;

comparing the speed comparison indicator to a threshold speed comparison indicator for determining if the fault has occurred; and in response to the fault having occurred, the controller is programmed for taking the at least one steering fault action.

5. The power steering system of claim 4, wherein:

the at least one steering fault action is at least a first steering fault action and a second steering fault action, and the threshold speed comparison indicator is a first threshold speed comparison indicator;

in response to the fault having occurred, the controller is programmed for taking the first steering fault action; and determining if the fault has occurred in the power steering system based on the steering rate and the speed of the motor further includes:

comparing the speed comparison indicator to a second threshold speed comparison indicator for determining if a second steering fault action is to be taken, and once the second steering fault action is determined to be taken, the controller is programmed for taking the second steering fault action.

6. The power steering system of claim 3, wherein the first steering fault action includes providing a warning indication to an operator of the power steering system.

7. The power steering system of claim 3, wherein the first steering fault action includes registering a fault code in the controller.

8. The power steering system of claim 3, wherein the second steering fault action includes limiting at least one of a maximum operative speed of the outdrive engine, a throttle request to the outdrive engine, and the speed of the motor of the power steering system.

9. The power steering system of claim 1, wherein the controller determines if the speed of the motor is above a threshold motor speed before determining if the fault has occurred in the power steering system based on the steering rate and the motor speed.

10. The power steering system of claim 1, wherein the steering actuator is a hydraulic steering actuator, and the motor is an electric motor driving a hydraulic pump.

11. The power steering system of claim 10, wherein the electric motor is a brushless direct current motor having an output shaft, and the motor speed sensor determines a rotational speed of the output shaft.

12. The power steering system of claim 1, wherein the controller is further configured to control the operation of the outdrive engine, the controller being configured to control at least one of the outdrive engine and the motor in response to the fault having occurred.

13. The power steering system of claim 1, wherein the steering input device is a tiller.

14. An outdrive engine comprising:

an engine;

a transmission operatively connected to the engine;

a propelling device operatively connected to the transmission; and the power steering system of claim 1.

15. A method for controlling a power steering system of an outdrive engine, comprising the steps of:

a) determining a steering rate of a propulsion unit of the outdrive engine about a steering axis;

b) determining at least indirectly a speed of a motor of the power steering system, the motor being configured for operating a steering actuator of the power steering system;

c) determining if a fault has occurred in the power steering system based on the steering rate and the speed of the motor; and d) taking at least one steering fault action in response to the fault having occurred.

16. The method of claim 15, wherein the determining if a fault has occurred includes calculating one of a ratio of the speed of the motor over the steering rate and a ratio of the steering rate over the speed of the motor.

17. The method of claim 15, wherein the determining if a fault has occurred includes calculating a normalized speed difference between the steering rate and the speed of the motor.

18. The method of claim 15, further comprising the step of determining if the speed of the motor is above a threshold motor speed before determining if the fault has occurred.

19. The method of claim 15, wherein the at least one steering fault action comprises at least a first steering fault action and a second steering fault action, and the first steering fault action includes at least one of providing a warning indication to an operator of the power steering system, and registering a fault code in a controller.

20. The method of claim 19, wherein the second steering fault action includes limiting at least one of a maximum operative speed of the outdrive engine, a throttle request to the outdrive engine, and the speed of the motor of the power steering system.

* * * * *